US007395791B2

(12) United States Patent
Isobe

(10) Patent No.: US 7,395,791 B2
(45) Date of Patent: Jul. 8, 2008

(54) VALVE TIMING CONTROLLER WITH A STOPPER

(75) Inventor: Eiji Isobe, Kariya (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 11/714,807

(22) Filed: Mar. 7, 2007

(65) Prior Publication Data

US 2007/0209622 A1 Sep. 13, 2007

(30) Foreign Application Priority Data

Mar. 9, 2006 (JP) ..... 2006-064531

(51) Int. Cl.
*F01L 1/34* (2006.01)

(52) U.S. Cl. ..... 123/90.17; 123/90.15; 464/160

(58) Field of Classification Search ..... 123/90.12, 123/90.13, 90.15, 90.16, 90.17, 90.18, 90.27, 123/90.31, 345, 346, 347, 348; 464/1, 2, 464/160

See application file for complete search history.

(56) References Cited

U.S. PATENT DOCUMENTS 6,502,537 B2 * 1/2003 Todo et al. ..... 123/90.17
6,883,482 B2 4/2005 Takenaka et al.
7,100,556 B2 9/2006 Sugiura

OTHER PUBLICATIONS

Hori et al., U.S. Appl. No. 11/712,553, filed Mar. 1, 2007, entitled "Valve Timing Controller".

* cited by examiner

*Primary Examiner*—Ching Chang
(74) *Attorney, Agent, or Firm*—Nixon & Vanderhye PC

(57) ABSTRACT

A valve timing controller is disclosed that includes first and second rotating elements, and a phase changing mechanism including arm members coupling the first and second rotating elements. The valve timing controller also includes a cam plate and a stopper to restrict rotation of the cam plate. A concave part where the stopper and the cam plate contact. Also, a damper chamber is defined between the concave part and one of the stopper and the cam plate.

11 Claims, 8 Drawing Sheets

VALVE TIMING CONTROLLER WITH A STOPPER

CROSS REFERENCE TO RELATED APPLICATIONS

The following is based on and claims priority to Japanese Patent Application No. 2006-64531, filed Mar. 9, 2006, which is hereby incorporated by reference in its entirety.

TECHNICAL FIELD

The present invention relates to a valve timing controller and, in particular, to a valve timing controller with a stopper.

BACKGROUND INFORMATION

There is conventionally known a device equipped with a phase changing mechanism for linking a sprocket rotating in association with a drive shaft to a lever member rotating in association with a driven shaft through a link arm. This kind of a phase changing mechanism is arranged to convert a motion of the link arm into a relative rotational motion of the lever member to the sprocket, thereby changing a relative rotational phase between the drive shaft and the driven shaft.

JP-200548707A, for instance, discloses technology for defining a changing angle of a relative rotational phase in a relative rotational motion of a cam plate (link part) as a lever member. In this technology, two stoppers are provided in a sprocket for restricting a position of the relative rotational phase of the cam plate. At a phase position where the rotational phase of the cam plate is at the most advance angle, the cam plate contacts an advance-side stopper, and on the other hand, at a phase position where the cam plate is at the most retard angle, the cam plate contacts a retard-side stopper. Contact between the stoppers and the cam plate defines a changing angle of the relative rotational phase between the drive shaft and the driven shaft.

The cam plate can collide with the stoppers at relatively high force. For instance, where a predetermined motion of the link arm and the cam plate is created by transmission of a rotational motion by an electric motor, and when power supply to the electric motor is stopped, the stoppers can experience a relatively large collision torque.

In partial response to this problem, an elastic member can be provided at the stopper with which the cam plate collides. As such, it is possible to alleviate the effect of the impact by interposing the elastic member between the cam plate and the stopper. However, since elastic response of the elastic member can change with a magnitude of the impact force, the phase position where the cam plate becomes the most retard angle can shift, which can adversely influence learning of the most retard angle.

SUMMARY

A valve timing controller is disclosed for a drive system which transmits torque of a drive shaft to a driven shaft for opening and closing of a valve to control opening and closing of the valve. The valve timing controller includes a first rotating element which rotates in association with the drive shaft and a second rotating element which rotates in association with the driven shaft. The valve timing controller also includes a phase changing mechanism part including arm members for coupling to the first rotating element and the second rotating element by a revolute pair to change a relative rotational phase between the first rotating element and the second rotating element caused by motion of the revolute pair of the arm members. The valve timing controller further includes a cam plate disposed at one of the first rotating element and the second rotating element so as to be rotated integrally therewith to be coupled to the arm members by the revolute pair. Moreover, the valve timing controller includes a stopper disposed in the other of the first rotating element and the second rotating element to restrict a rotational angle of the cam plate in a predetermined range. A changing angle of the relative rotational phase between the first rotating element and the second rotating element is defined by contacting the cam plate to the stopper. A concave part having a bottom is disposed at one of the stopper and the cam plate and formed in a contact face part where the stopper and the cam plate contact such that the other is inserted into the concave part. Additionally, a damper chamber is defined between the concave part and the other of the stopper and the cam plate.

BRIEF DESCRIPTION OF THE DRAWINGS

Other objects, features, and advantages of the present invention will become more apparent from the following detailed description made with reference to the accompanying drawings, in which like portions are designated by like reference numbers and in which.

DETAILED DESCRIPTION

First Embodiment

Figure 1:
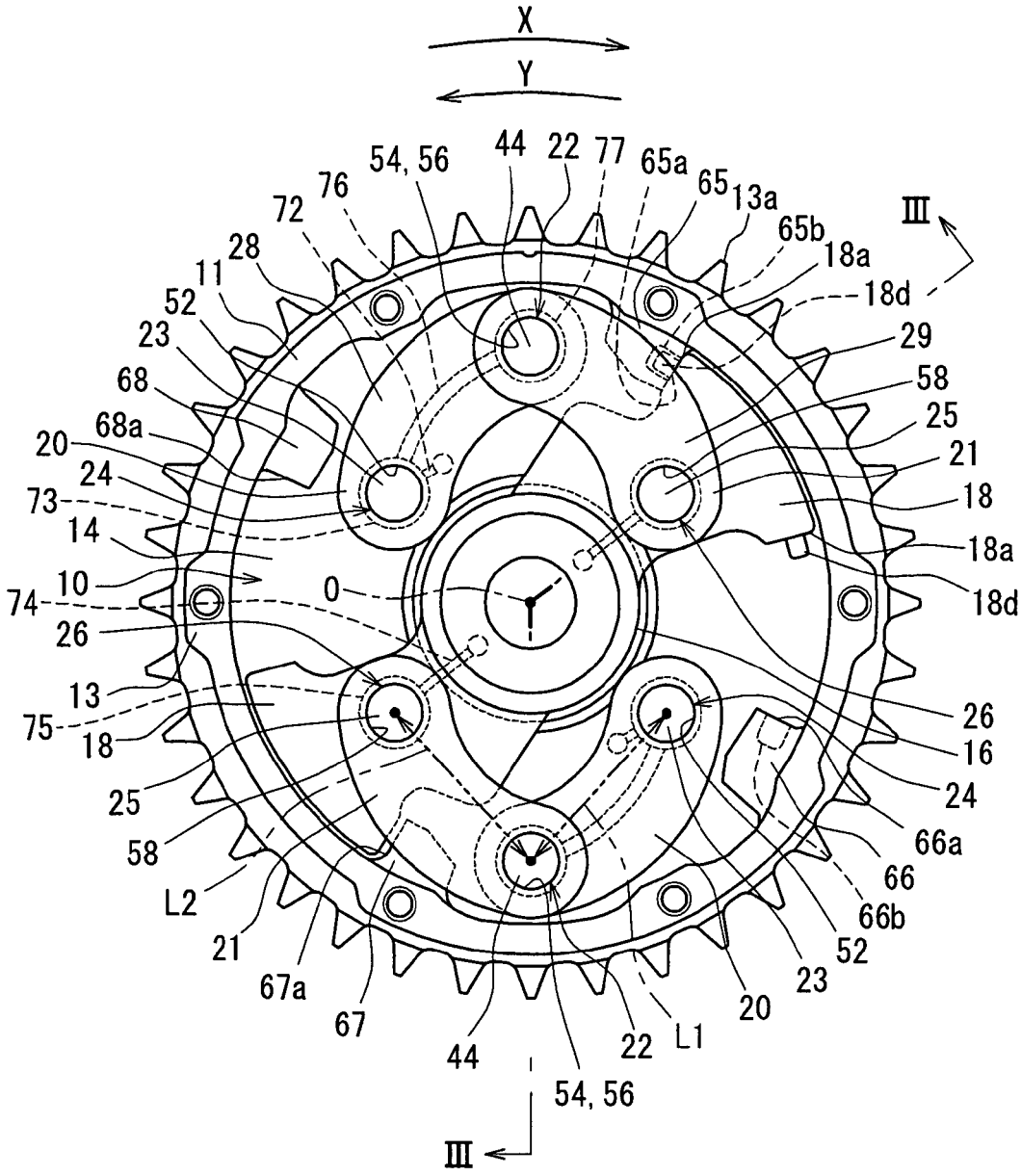
FIG. 1 is a cross sectional view of one embodiment of a valve timing controller taken on line I-I of FIG. 3.
Figure 3:
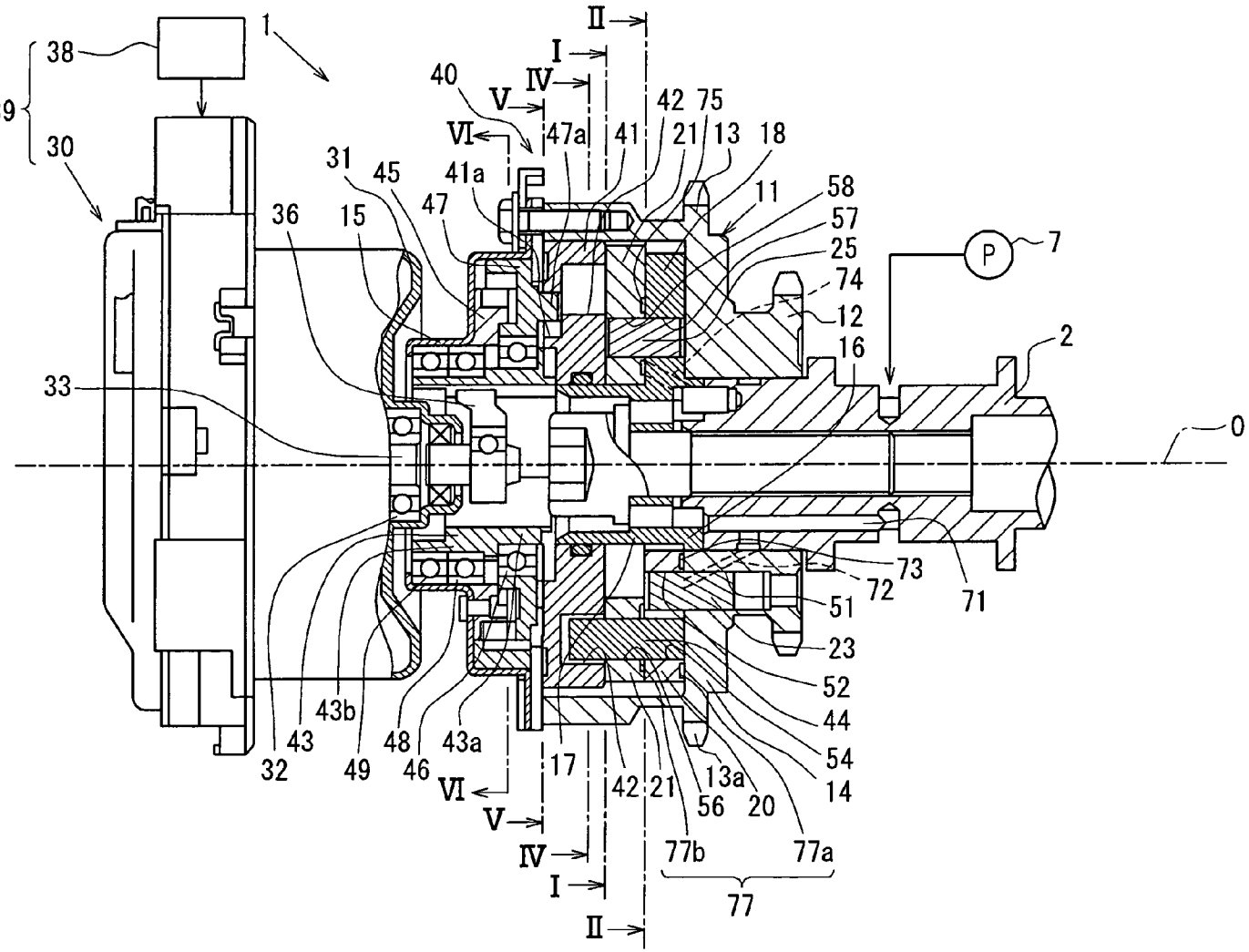
FIG. 3 is a cross sectional view of one embodiment of the valve timing controller.
Figure 7:
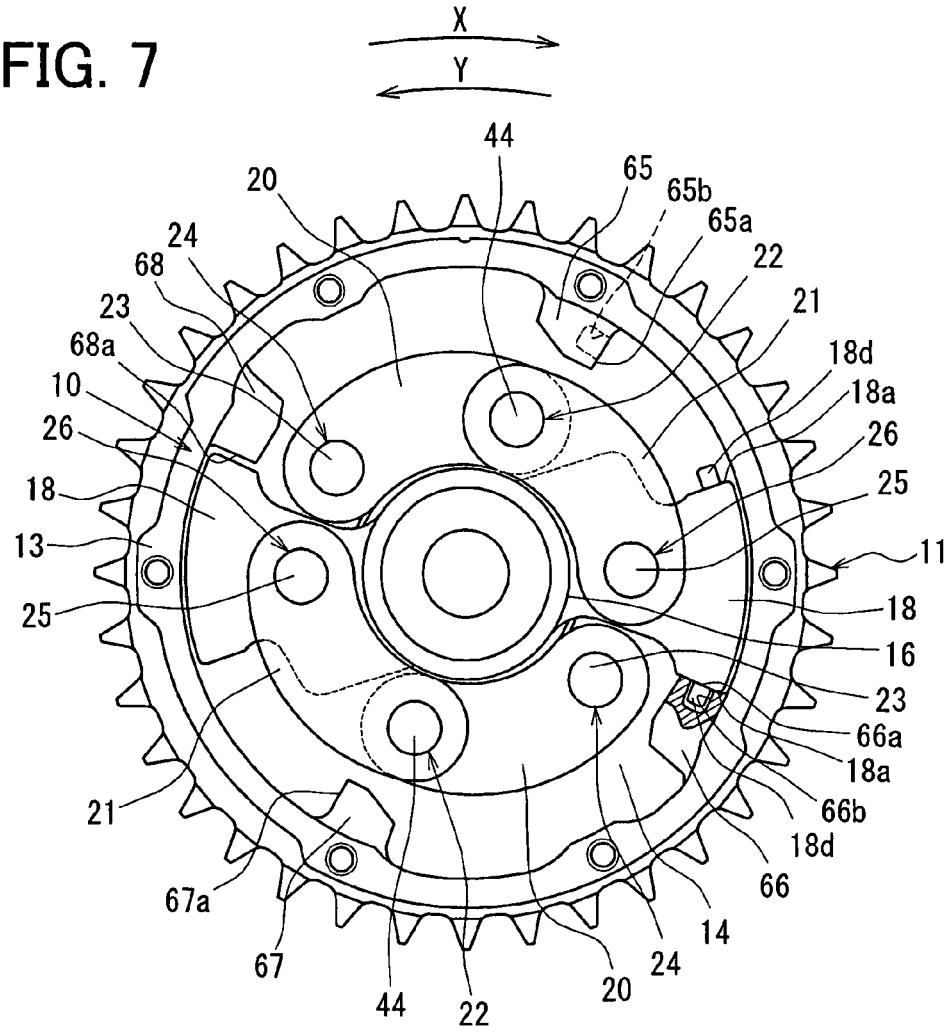
FIG. 7 is a cross sectional view of the valve timing controller of FIG. 2A in an operating state of the valve timing controller.
Figure 8:
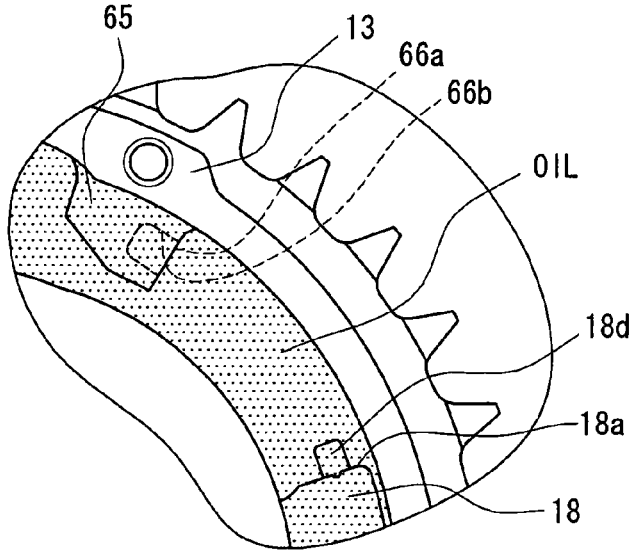
FIG. 8 is an enlarged partial cross sectional view of FIG. 7.

FIG. 1 shows a state in which a rotational phase is located in a phase position to be the most retard angle and FIG. 7 shows a state in which a rotational phase is located in a phase position to be the most advance angle. As shown in FIG. 3, in an internal combustion engine (hereinafter referred to as "engine"), a valve timing controller 1 is disposed in a transmission system which transmits driving torque in a crankshaft (not shown) as a driving shaft to a camshaft 2 as a driven shaft. The valve timing controller 1 changes a relative rotational phase between the crankshaft and the camshaft 2, thus adjusting valve timing of an intake valve or an exhaust valve of the engine.

The valve timing controller 1 is provided with a phase changing mechanism 10 as a link mechanism part, an electric motor 30 and a motion changing mechanism 40.

As shown in both FIG. 1 and FIG. 3, the phase changing mechanism 10 is arranged by combining a sprocket 11 as a driving rotating element, an output shaft 16 as a driven rotating element and arm members 20, 21. The phase changing mechanism 10 changes and adjusts a relative rotational phase between the rotating elements 11, 16 or between the crankshaft and the camshaft 2.

The sprocket 11 integrally includes a support cylindrical part 12, an input cylindrical part 13 which is larger in diameter than the support cylindrical part 12, and a link part 14 (hereinafter referred to as "first link part") which connects the support cylindrical part 12 and the input cylindrical part 13. The support cylindrical part 12 is disposed co-axially with the output shaft 16 and is rotatably supported by an outer peripheral wall. That is, the sprocket 11 rotates around a rotational center O and relative to the output shaft 16.

A chain belt (not shown) is wound around and between a plurality of teeth 13*a* formed in the input cylindrical part 13 and a plurality of teeth formed in the crankshaft. When the driving torque of the crankshaft is inputted into the input cylindrical part 13 by the chain belt, the sprocket 11 rotates clockwise around the rotational center O of FIG. 1.

The output shaft 16 includes integrally a fixed part 17 and a second link part 18. One end of the fixed part 17 is fixed coaxially with one end of the camshaft 2. The output shaft 16 rotates around the rotational center O with the camshaft 2, and relative to the sprocket 11.

A cover 15 fixed in the input cylindrical part 13 and the link part 14 hold the arm members 20, 21 tightly with the link part 18 and each element 41, 44, 45, 47 of the motion converting mechanism 40 therebetween. The first arm member 20 engages with the link part 14 of the sprocket 11 by the revolute pair, and the second arm member 21 engages with the link part 18 and the first arm member 20 respectively by the revolute pair. By the engagements, the output shaft 16 rotates in the same direction as the sprocket 11 caused by rotation of the crankshaft.

The engagements enable the output shaft 16 to rotate in an advancement direction X and in a retard direction Y relative to the sprocket 11. The arm members 20, 21 engage with a moving part 44 in the motion converting mechanism 40 by a revolute pair. According to this, in the phase changing mechanism 10, the revolute pair 22 formed of the arm members 20, 21 moves in association with the moving part 44, and the motion of this revolute pair 22 is to be converted into the relative rotational motion of the sprocket 11 and the output shaft 16.

As shown in FIG. 3, a control unit 39 as control means is also provided. The control unit 39 includes an electric motor 30, a power controlling circuit 38 and so forth. The electric motor 30 is disposed opposite to the camshaft 2 with the rotating elements 11, 16 interposed therebetween. In one embodiment, the electric motor 30 is an electric component such as a brushless motor, which includes a motor case 31 fixed to the engine through a stay (not shown) and a rotating shaft 33 (hereinafter referred to as "motor shaft") supported by a bearing 32 disposed in the motor case 31 so as to rotate in two directions.

The motor shaft 33 is disposed coaxially with the sprocket 11 and the output shaft 16 and has both axial ends supported by the bearing 32, and is also linked and fixed to an input shaft 46 through a shaft joint 36. The motor shaft 33 rotates with the input shaft 46 around the rotational center O.

The power control circuit 38 is constructed of an electric circuit such as a microcomputer and is disposed inside or outside of the motor case 31 to be connected electrically with the electric motor 30. The power control circuit 38 controls power supply to a coil of the electric motor 30 (not shown) in accordance with an engine operating condition or the like. This power supply causes the electric motor 30 to form a rotating magnetic field around the motor shaft 33 and to output the rotating torque in the directions X and Y (refer to FIG. 6) in accordance with the rotating magnetic field from the motor shaft 33.

As shown in FIG. 3, the motion converting mechanism 40 is constructed by combining the guide member 41, the moving part 44, the planetary gear 45, the input shaft 43, the ring gear 47, and bearings 46, 48, 49.

Figure 4:
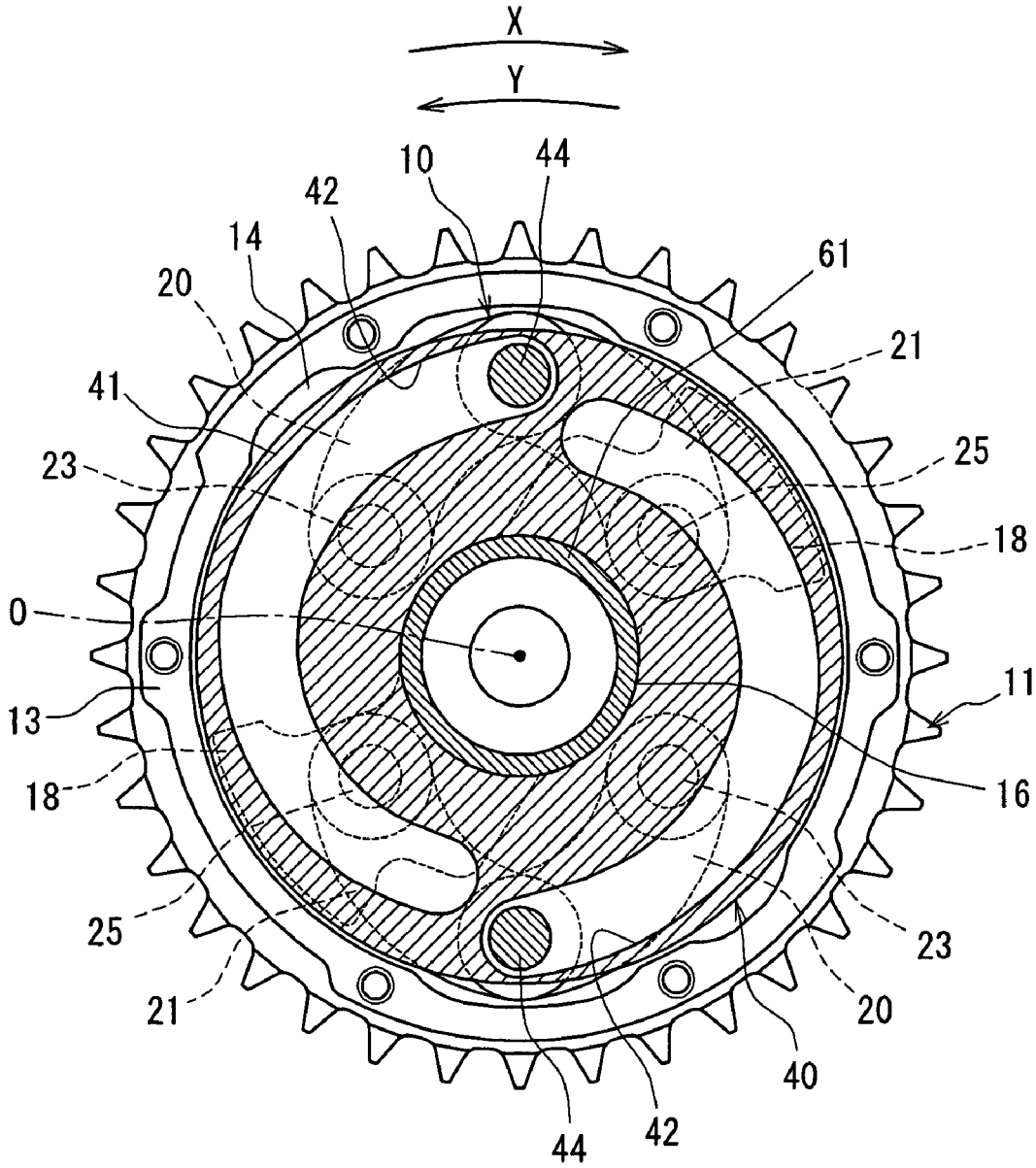
FIG. 4 is a cross sectional view of the valve timing controller taken on line IV-IV of FIG. 3.

As shown in FIGS. 3 and 4, the guide member 41 is formed in a circular ring plate shape coaxial with the output shaft 16 and is supported by the outer peripheral wall of the output shaft 16. The guide member 41 rotates around the rotational center O and in the directions X and Y relatively to the sprocket 11. Guide passages 42 for guiding the moving member 44 are formed in an elongated shape at two locations of the guide member 41 on opposite sides of the rotational center O. Each guide passage 42 is formed so as to have the guide member 41 as the bottom in the thickness direction and disposed in rotation symmetry of 180 degrees around the rotational center O as the axis of symmetry.

As shown in detail in FIG. 4, the elongated bore of each guide passage 42 is formed in a substantially spiral shape a radius of curvature of which gradually changes. Each guide passage 42 extends so as to be inclined relative to a radial axis of the guide member 41, and formed such that the distance from the rotational center O changes in the extending direction. It will be appreciated that the elongated shape of the passage 42 is not limited to this structure and may linearly extend to be inclined to the radial axis.

Figure 5:
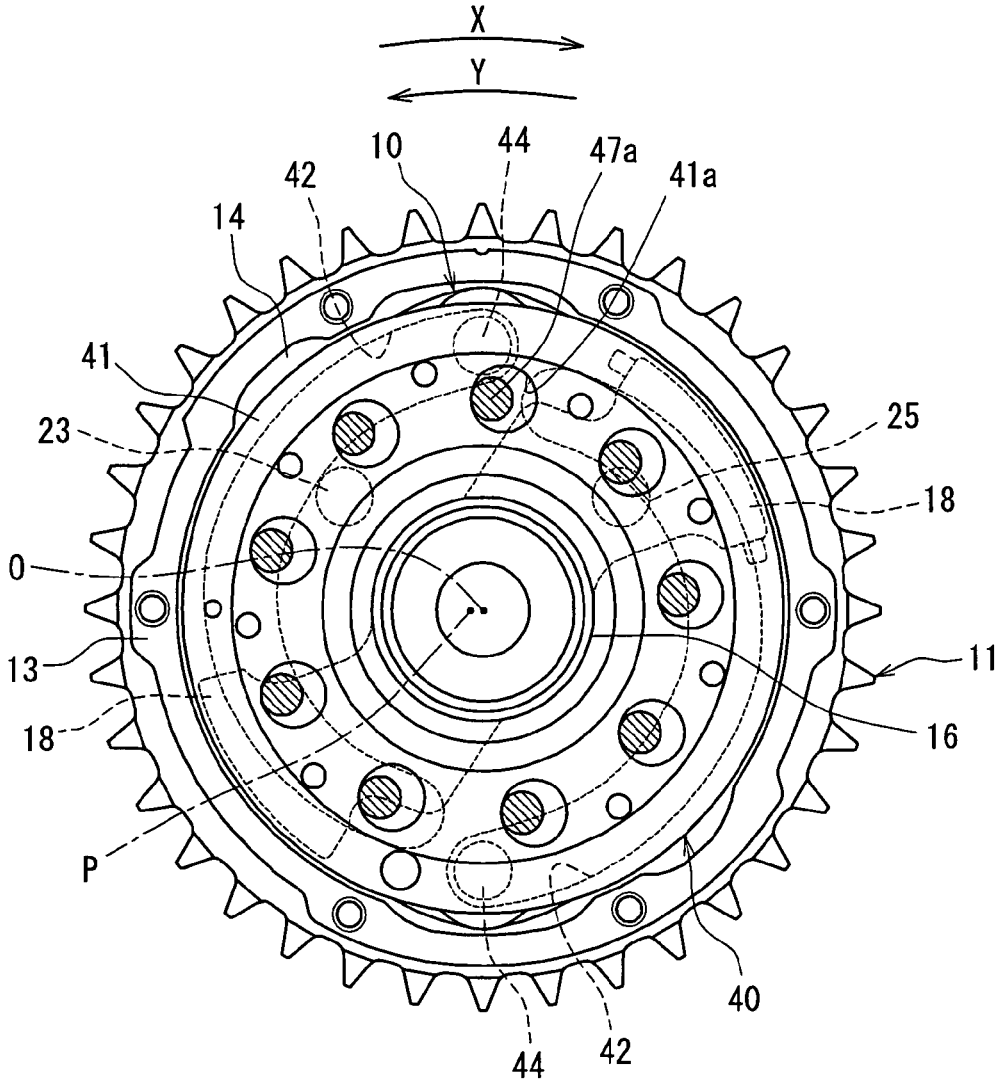
FIG. 5 is a cross sectional view of the valve timing controller taken on the line V-V of FIG. 3.

As shown in FIGS. 3 and 5, the guide member 41 is provided with an engagement bore 41*a* opposite the arm members 20, 21 for guiding an engagement projection 47*a* of the ring gear 47. The engagement bores 41*a* are formed cylindrically at a plurality of locations of the guide member 41. Each engagement bore 41*a* is formed in such a manner as to have the guide member as the bottom in the thickness direction and are disposed in equal intervals around the rotational center O.

Two moving parts 44 are provided in a location corresponding to the guide passage 42. Each moving part 44 is formed in a columnar shape and is held tightly between the link part 14 and the guide member 41 to be eccentric to the rotational center O. One end of each of the moving parts 44 fits and engages in the corresponding guide passage 42 by the sliding revolute pair. The other end of each of the moving parts 44 fits and engages in the corresponding arm member 20, 21 by the revolute pair.

Figure 6:
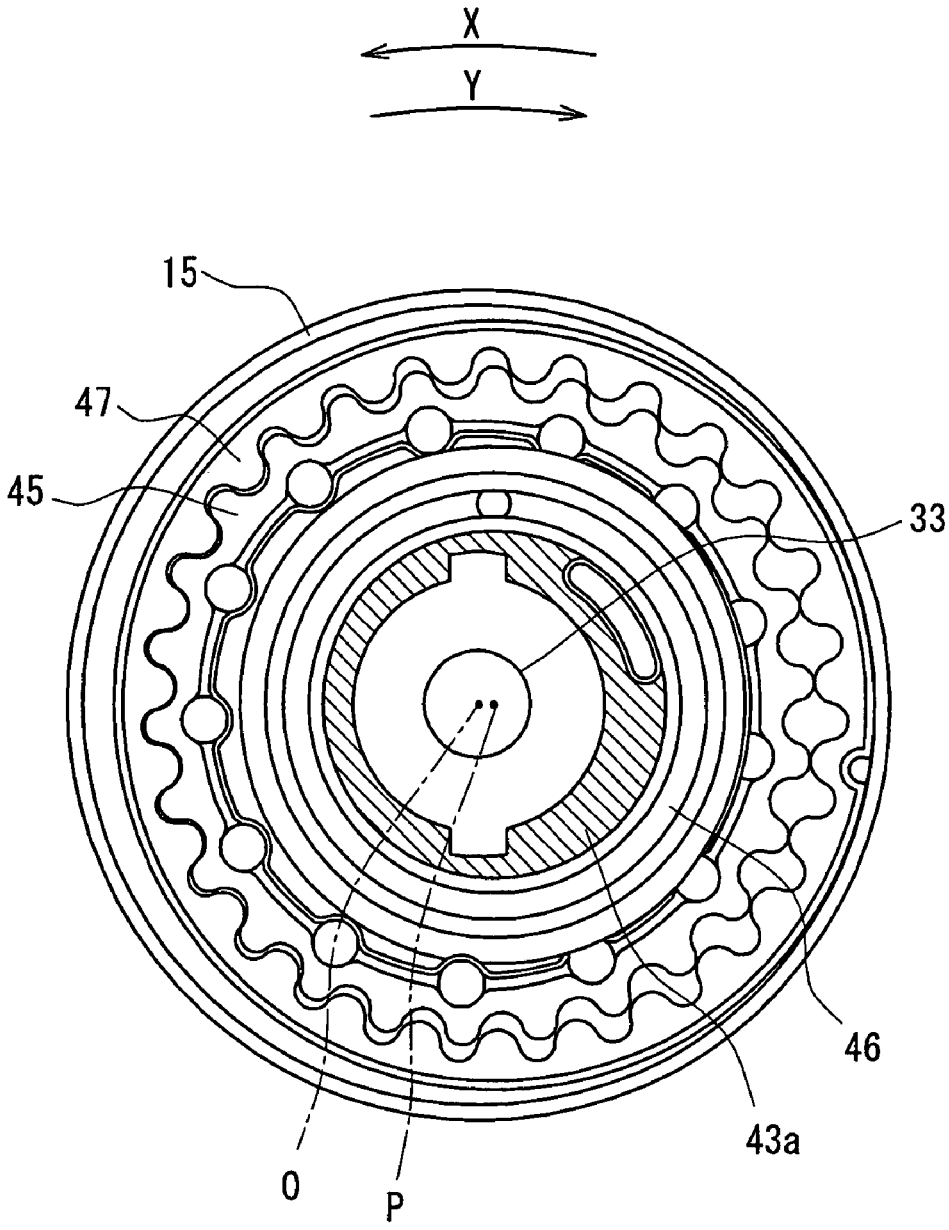
FIG. 6 is a cross sectional view of the valve timing controller taken on line VI-VI of FIG. 3.

As shown in FIGS. 3 and 6, an input part 43*b* of the input shaft 43 is a cylindrical shaft coaxial with the rotating elements 11, 16 and the camshaft 2, and is fixed to the motor shaft 33 through the shaft joint 36. As such, the input shaft 43 rotates around the rotational center O in association with movement of the motor shaft 33, and rotates relative to the sprocket 11. The input part 43*b* has the bearings 48, 49 attached thereto, and the input part 43*b* supports the planetary gear 45 via the bearing 48. The input part 43*b* also supports the cover 15 via the bearing 49. Therefore, the motor shaft 33, which is coupled with the input shaft 43, rotates in the X and Y directions relative to the sprocket 11.

As shown in FIGS. 3 and 6, the output part 43*a* of the input shaft 43 is at the side of the support cylindrical part 12 from the input part 43*b* and is cylindrical. The output part 43*a* has an outer peripheral wall eccentric to the rotating elements 11, 16 and the camshaft 2. The output part 43*a* supports the planetary gear 47 via the bearing 46.

In addition, the output part 43*a* of the output shaft 43 is connected and fixed to the motor shaft 33 to be eccentric to the rotational center O. P in FIG. 6 represents the center of the output part 43*a*.

The planetary gear 45 is formed of an external gear whose tip curvature is located at an outer periphery of a root curvature. A curvature radius of the tip curvature of the planetary gear 45 is smaller than that of the root curvature of the ring gear 47, and the number of teeth of the planetary gear 45 is reduced by a prescribed N (e.g., reduced by one in this embodiment) as compared to the number of teeth of the ring gear 47. The planetary gear 45 is disposed in an interior side of the ring gear 47, and a number of the plurality of teeth engages with a part of a plurality of teeth of the ring gear 47. Therefore, the planetary gear 45 is able to make a planetary motion relative to the ring gear 47.

As shown in FIGS. 3 and 6, the ring gear 47 is formed of an internal gear whose tip curvature is located at an interior of a root curvature. The ring gear 47 is provided with columnar engagement projections 47*a* at plural locations facing the respective engagement bores 41*a* of the guide member 41. The engagement projections 47*a* are provided at equal intervals around a center P of the input shaft 43, and protrude into the corresponding engagement bores 41*a*.

Further, as shown in FIG. 3, an operating fluid is included. In one embodiment, the operating fluid is an oil such as an engine oil. The oil is supplied from an oil pump 7 in the engine and is reserved in the sprocket 11. More specifically, the operating oil enters into the sprocket through an operation oil passage 71 (hereinafter referred to as "first operating oil passage") formed in the cam shaft 2 and for example, the operating oil discharged into an operating oil passage (not shown) through a gap between the sprocket 11 and the cover 15 is returned back to the oil pump 7. The supply of the operating oil is not limited to the operating oil supply path such as the first operating oil passage 71 for supplying the operating oil inside the sprocket 11. In another embodiment, for instance, the oil is filled in advance and a predetermined amount of the operating oil is reserved in the sprocket 11.

In such motion converting mechanism 40, when the motor shaft 33 does not rotate relative to the sprocket 11, the planetary gear 45 rotates together with the sprocket 11 and the input shaft 43 through rotation of the crankshaft, while maintaining the engagement position with the ring gear 47. Since the engagement projection 47*a* pushes the engagement bore 41*a* in the rotating direction, the guide member 41 rotates keeping the relative rotational phase to the sprocket 11. At this point, the moving part 44 does not slide relatively to the guide passage 42, and rotates with the guide member 41 keeping a certain distance from the rotational center O.

However, when increasing control torque or the like causes the motor shaft 33 to rotate in the retard direction Y relatively to the sprocket 11, the planetary gear 45 changes an engaging position with the ring gear 47, while rotating relative to the input shaft 43 by a planetary motion in a counter-clockwise direction in FIG. 6. An increasing force of the engagement projection 47*a* pushing the engagement bore 41*a* toward the rotating direction causes the guide member 41 to rotate in the advance direction X relative to the sprocket 11. At this point, the moving part 44 slides relatively along the guide passage 42, changing the distance from the rotational center O. For example, the moving member 44 relatively slides toward a side remote from the rotational center O to the guide passage 42, increasing the distance from the rotational center O.

However, when increasing control torque or the like causes the motor shaft 33 to rotate in the advance direction X relative to the sprocket 11, the planetary gear 45 changes an engaging position with the ring gear 47, while rotating relative to the input shaft 43 by a planetary motion in a clockwise direction in FIG. 6. Further, the engagement projection 47*a* is to push the engagement bore 41*a* toward the direction opposite the rotating direction, causing the guide member 41 to rotate in the retard direction Y relative to the sprocket 11. At this point, the moving part 44 relatively slides along the guide passage 42, changing the distance from the rotational center O. For example, the moving member 44 relatively slides toward a side near the rotational center O to the guide passage 42, reducing the distance from the rotational center O.

The motion converting mechanism 40 thus converts a rotating motion of the electric motor 30 into a motion of the moving part 44. The electric motor 30 and the motion converting mechanism 40 correspond to control means for controlling a motion of the revolute pair 22 moving in association with the moving part 44.

Next, the phase changing mechanism 10 will be in detail explained with reference to FIG. 1, FIG. 3 and FIG. 7. FIG. 1 shows a state in which a rotational phase is located in a phase position to be the most retard angle and FIG. 7 shows a state in which a rotational phase is located in a phase position to be the most advance angle.

In the phase changing mechanism 10, the first arm member 20 is formed in an arched plate shape, and each is disposed at opposite sides of the rotational center O. The first link part 14 is formed in a circular-ring plate shape coaxial with the output shaft 16. Two locations in the link part 14 on opposite sides of the rotational center O contact ends of the corresponding respective first arm members 20, linking them through a shaft member 23. The shaft member 23 is columnar and eccentric to the rotational center O, and the first link part 14 and each of the first arm members 20 constitute the revolute pair 24 (hereinafter referred to as "first pair").

More specially, a bore part 51 is formed in a cylindrical shape at each of two locations on opposite sides of the rotational center line O in each first link part 14, a center line of the bore part 51 being eccentric to the rotational center line O. The two shaft members 23 are located corresponding to the respective bore parts 51. One end of the each shaft member 23 fits with the corresponding bore part 51. A bore part 52 (hereinafter referred to as "first bore part"), in a cylindrical shape whose center line is eccentric to the rotational center line O is formed at one end in a longitudinal direction of each first arm member 20. The first bore part 52 of the first arm member 20 fits with the other end of the corresponding shaft member 23, enabling it to relatively rotate. Each first arm member 20 is located so as to contact with the first link part 14 in a surrounding area of the first bore part 52 engaging with the shaft member 23. In the above embodiment, the first pair 24 formed of the first link part 14 and the first arm member 20 is arranged by an engagement of the bore parts 51, 52 formed in these elements 14, 20, and the shaft member 23.

The second arm member 21 is formed in an arched plate shape, and each of it is located respectively at both sides sandwiching the rotational center O. The second link part 18 is formed in a rectangular plate shape which extends toward a radial outside direction in opposing directions with each other from two locations sandwiching the rotational center O of the fixed part 17. With the intermediate portion of the extending direction in each of the second link parts 18, one end of the corresponding second arm member 21 contacts and moves in association through the shaft member 25. The shaft member 25 is columnar and eccentric to the rotational center O, and the second link part 18 and each of the second arm members 21 constitute the revolute pair 26 (hereinafter referred to as "second pair"). It should be noted that in the first embodiment, the distance between each center of the second pair 26 and the rotational center is equal.

More specifically, a bore part 57 is formed in a cylindrical shape in each second link part 18, a center line of the bore part 57 being eccentric to the rotational center line O. The two shaft members 25 are located corresponding to the respective bore parts 57 of the second link parts 18. One end of the each shaft member 25 fits with the corresponding bore part 57. A bore part 58 (hereinafter referred to as "second bore part"), in a cylindrical shape whose center line is eccentric to the rotational center line O is formed at one end in a longitudinal direction of each second arm member 21. The second bore part 58 of the second arm member 21 fits with the other end of the corresponding shaft member 25, enabling it to relatively rotate. Each second arm member 21 is located so as to contact with the second link part 18 in a surrounding area of the second bore part 58 engaging with the shaft member 25. In the above embodiment, the second pair 26 formed of the second link part 18 and the second arm member 21 is arranged by an engagement of the bore parts 57 and 58 formed in these elements 18, 21 and the shaft member 25.

An end in an opposite side of the second pair 26 of each second arm member 21 contacts with an end in an opposite side of the first pair 24 of the corresponding first arm member 20, and they move together through the moving part 44. The moving member 44 is columnar and eccentric to the rotational center O, and each first arm member 20 and each second arm member 21 constitutes the revolute pair 22 (hereinafter referred to as "third pair").

More specifically, a bore part 54 (hereinafter referred to as "first arm member-side third bore part") is formed in a cylindrical shape, a center line of which is eccentric to the rotational center line O is formed in the other end part in the longitudinal direction of each first arm member 20. A bore part 56 (hereinafter referred to as "second arm member-side third bore part") is formed in a cylindrical shape, a center line of which is eccentric to the rotational center line O is formed in the other end part in the longitudinal direction of each second arm member 21. The two moving members 44 are located corresponding to the first arm member-side third bore part 54. One end of the moving member 44 relatively rotatably fits with the corresponding first arm member-side third bore part 54. The other end of the moving member 44 relatively rotatably fits with the corresponding second arm member-side third bore part 56. Each second arm member 21 is located so as to contact with the first arm member 20 in a surrounding area of the second arm member-side third bore part 56 engaging with the moving member 44. In the above first embodiment, the third pair 22 formed of the first arm member 20 and the second arm member 21 is arranged by an engagement of the bore parts 54, 56 formed in these elements 20, 21 and the moving member 44.

As shown in FIG. 1, one of the second link parts 18 contacts a stopper 65 (hereinafter referred to as "retard side stopper") when a relative rotational phase of the output shaft 16 to the sprocket 11 is the most retard phase. This retard side stopper 65 is located in the first link part 14 of the sprocket 11. In addition, one of the second link parts 18, as shown in FIG. 7, contacts an advance side stopper 66 when a relative rotational phase of the output shaft 16 to the sprocket 11 is the most advance phase. This advance side stopper 66 is located in the first link part 14.

In such phase changing mechanism 10, when the distance between the rotational center O and the moving part 44 is maintained, each location of the first, second and third pairs 24, 26, 22 does not change. As a result, the output shaft 16 rotates with the camshaft 2, maintaining the relative rotational phase to the sprocket 11. Therefore the relative rotational phase of the camshaft 2 to the crankshaft is maintained to be constant.

On the other hand, when the distance between the rotational center O and the moving part 44 increases, for example when transferring from a state where a relative rotational phase of the output shaft 16 to the sprocket 11 is the most advance phase shown in FIG. 7 to a state where it is the most retard phase shown in FIG. 1, as the position of the third pair 22 moves away from the rotational center O, the first arm member 20 rotates relatively around each center of the shaft member 23 and the moving part 44 to the first link part 14 and the second arm member 21. At the same time, the second arm member 21 rotates relatively around a center of the shaft member 25 to the second link part 18, and a position of the second pair 26 moves closer to the retard direction Y to the position of the first pair 24. As a result, the output shaft 16 rotates in the retard direction Y relative to the sprocket 11, which causes the retard of the relative rotational phase of the camshaft 2 to the crankshaft.

On the other hand, when the distance between the rotational center O and the moving part 44 reduces, for example when transferring from a state where a relative rotational phase of the output shaft 16 to the sprocket 11 becomes the most retard phase shown in FIG. 1 to a state where it becomes the most advance phase shown in FIG. 7, as the position of the third pair 22 moves closer to the rotational center O, the first arm member 20 rotates relatively around each center of the shaft member 23 and the moving part 44 to the first link part 14 and the second arm member 21. At the same time, the second arm member 21 rotates relatively around a center of the shaft member 25 to the second link part 18, and a position of the second pair 26 moves away to the advance direction X from the position of the first pair 24. As a result, the output shaft 16 rotates in the advance direction X relative to the sprocket 11, which causes the advance of the relative rotational phase of the camshaft 2 to the crankshaft.

Figure 2A:
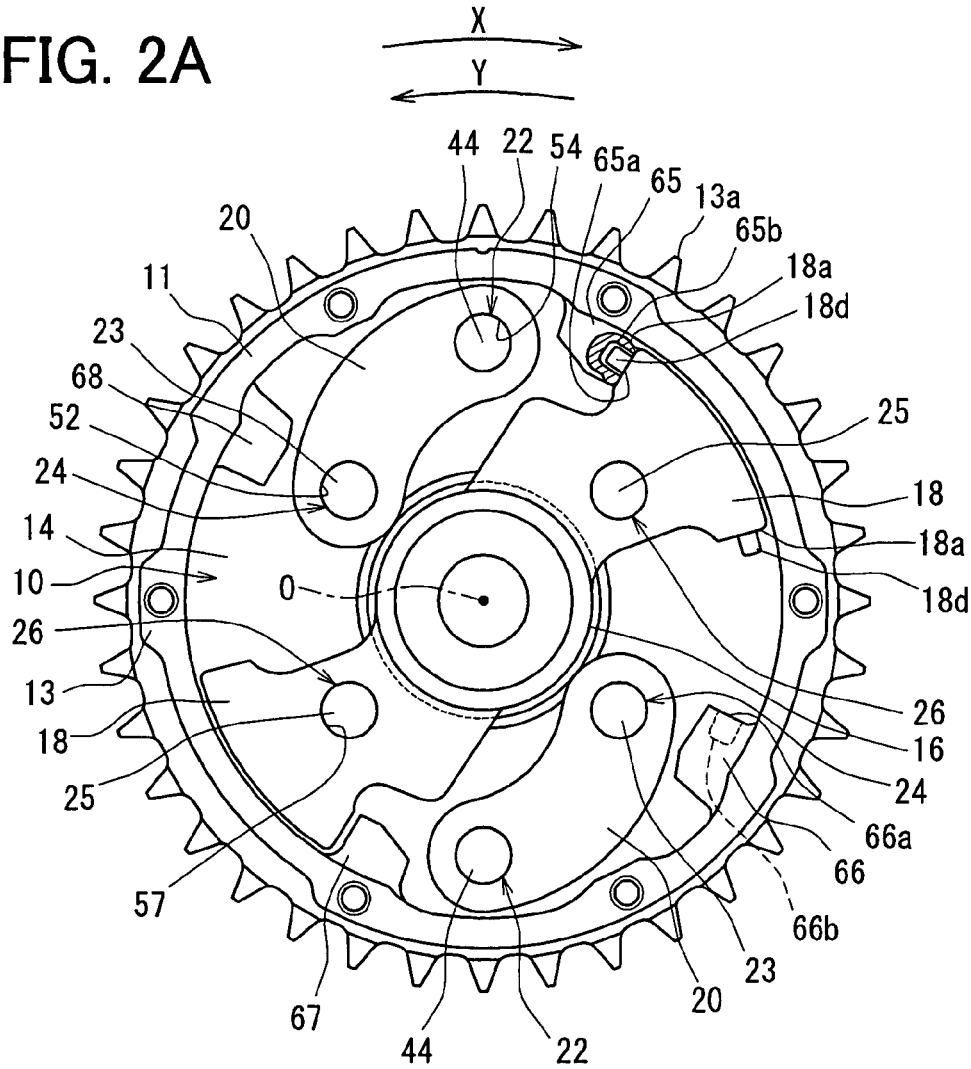
FIG. 2A is a cross sectional view of the valve timing controller taken on line II-II of FIG. 3.

As shown in FIG. 1 and FIG. 2A, one of the second link parts 18 contacts a stopper 65 (hereinafter referred to as "retard side stopper") when a relative rotational phase of the output shaft 16 to the sprocket 11 is the most retard phase. The retard side stopper 65 is located in the first link part 14 of the sprocket 11. In addition, one of the second link parts 18, as shown in FIG. 7, contacts an advance side stopper 66 when a relative rotational phase of the output shaft 16 to the sprocket 11 is the most advance phase. This advance side stopper 66 is located in the first link part 14.

It should be noted that a difference in relative rotational phase between the most retard phase and the most advance phase corresponds to a changing angle of the relative rotational phase.

It is preferable that each stopper 65, 66 is located at an outer peripheral part in the sprocket 11 (in detail, at an outer peripheral part of the first link part 14).

Further, as shown in FIG. 2A and FIG. 3, each stopper 65, 66 is provided with a concave part 65*b*, 66*b* having a bottom formed on surfaces 65*a*, 66*a* (hereinafter referred to as "contact face part") which the second link part 18 contacts. A convex part 18*d* inserted in each concave part 65*b*, 66*b* is formed on each contact face part 18*a* of the second link part 18 contacting each contact face part 65*a*, 66*a*.

Figure 2B:
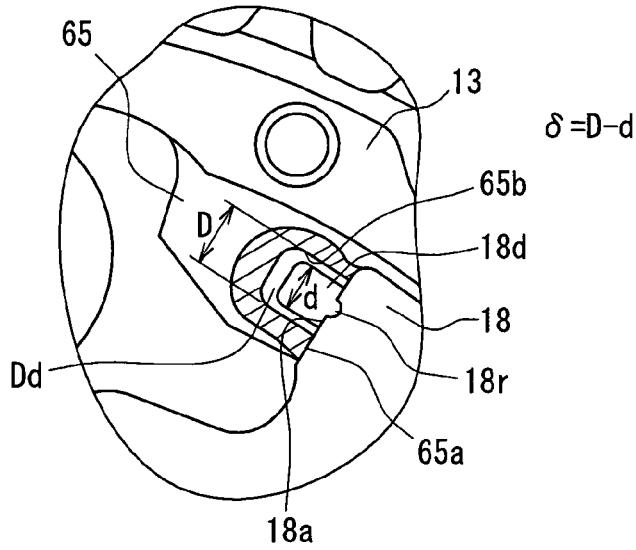
FIG. 2B is a cross sectional view of an enlarged portion of FIG. 2A.

Each convex part 18*d* of the second link part 18 is formed in such a manner as to be slidable in the concave part 65*b* of the corresponding retard side stopper 65 and in the concave part 66*b* of the corresponding advance side stopper 66. It should be noted that in the following embodiment, a detail with respect to the concave part 65*b* of the retard side stopper 65 and the convex part 18*d* of the second link part 18 will be explained and an explanation with respect to the concave part 66*b* of the advance side stopper 66 and the convex part 18*d* of the second link part 18 is omitted As shown in FIG. 2B, the concave part 65*b* and the convex part 18*d* are sized and configured in a cylindrical shape so as to be inserted with each other. A clearance δ (hereinafter referred to as "sliding clearance") is set between an outer periphery (inner diameter D) of the concave part 65*b* and an outer diameter d of the convex part 18*d* so as to be slidable with each other (δ=D−d). A damper chamber Dd is defined between the concave part 65*b* and the convex part 18*d*. This damper chamber Dd is formed when the sliding clearance δ is formed between the concave part 65*b* and the convex part 18*d*. At the time of formation of the damper chamber Dd, a part of the operating oil reserved in the sprocket 11 is filled in the damper chamber Dd and closed from the sprocket 11 through the relatively minute sliding clearance δ.

The operating oil in the closed damper chamber Dd increases in pressure as the convex part 18*d* is inserted into the concave part 65*b* by a relative rotation between the second link part 18 and the retard side stopper 65. Then, the pressure damping effect by the hydraulic pressure generating in the operating oil inside the damper chamber Dd acts on the second link part 18 and the retard side stopper 65 which are to contact on the contact face parts 18*a* and 65*a*. As a result, the collision between the second link part 18 and the retard side stopper 65 is alleviated.

The sliding clearance δ is set as a predetermined clearance amount. Changing a size of the sliding clearance δ allows an increase amount in the pressure generated in the operating oil inside the damper chamber Dd to be changed, thus adjusting the pressure damping effect.

Further, in the first embodiment, an amount of the operating oil reserved in the sprocket 11 is set such that at least a predetermined amount of the operating oil is reserved. This predetermined amount of the operating oil is equal to the extent that the operating oil fills a surrounding area between each concave part 65*a*, 66*b* of each stopper 65, 66 and the convex part 18*d* of the second link part 18 in a state when the operating oil is reserved partially at the side of the outer peripheral part inside the sprocket 11 (outer peripheral part of the first link part 14) by a centrifugal force at the time the sprocket 11 and the output shaft 16 rotate by drive torque of the crank shaft.

As such, even in a case where a portion of the operating oil is reserved in the sprocket 11, when the second link part 18 is contacted to the stoppers 65, 66 at the engine operating time, it is possible to constantly supply the operating oil to the each concave part 65*a*, 66*b* of each stopper 65, 66 and the convex part 18*d* of the second link part 18. By thus setting the operating oil amount, it is not required to charge the operating oil for filling it in the sprocket 11.

In the first embodiment, the operating oil supply path is configured as follows for reserving the operating oil in the sprocket 11. An orifice is provided in an inlet port to the sprocket 11 in the operating oil supply path to limit a flow amount of the operating oil flowing into the sprocket 11 to a predetermined amount. This causes reduction in the operating oil pressure in the engine side to be controlled so as to be relatively low.

In addition, it is preferable that the operating oil supply path is, as shown in FIGS. 1 and 3, provided with operating oil passages 72, 74 connected to the engagement part between shaft members 23, 25, 44 constituting the first revolute pair 24, the second revolute pair 26 and the third revolute pair 22, and the bore parts 52, 58, 54, 56. More specially, the second operating oil passage 72 is formed at the first link part 14 such that one end thereof is branched from the first operating oil passage 71 and the other end is directed to the engagement part between the first bore part 54 of the arm member 20 and the shaft member 23. The third operating oil passage 74 is formed at the second link part 18 such that one end thereof is communicated with an opening of the first operating oil passage 71 and the other end is directed to the engagement part between the second bore part 58 of the second arm member 21 and the shaft member 25.

This allows the operating oil to be reserved in the sprocket 11 and the flow of the operating oil for supplying the operating oil to be formed at the engagement part between the shaft members 23, 25 which are rotated with each other and the bore parts 52, 58.

Further, a clearance (hereinafter referred to as "second sliding clearance") between the bore parts 52, 58 corresponding to the engagement part and the shaft members 23, 25 may have a function of limiting a flow amount in the sprocket 11 in response to a size of the clearance. As a result, it is possible to reserve a predetermined amount of the operating oil inside the sprocket 11 and the engagement part is lubricated with the operating oil by flowing the operating oil the inflow of which is limited through the clearance of the engagement part.

Further, as shown in FIGS. 1 and 7, an end face of the first arm member 20 opposite the first link part 14 is so constructed that the opening of the engagement part between the shaft member 23 and the first bore part 52 is entirely exposed. However, the end face is not limited to this structure, and in another embodiment only a portion of the engagement part is exposed.

In addition, in the first embodiment, as shown in FIGS. 1 and 3, there are provided circular grooves 73, 75, 77*a*, 77*b* for introducing the operating oil in a surrounding area (outer edge part) between the shaft members 23, 25, 44 and the bore parts 52, 58, 54, 56. More specifically, a circular groove in a circular-ring shape 73 (hereinafter referred to as "first circular groove") is formed in a surrounding area (outer edge part) of the first bore part 52 at an end face of the first arm member 20 in the side of the first link 14. A circular groove in a circular-ring shape 77*a* (hereinafter referred to as "third circular groove in the side of the first arm member") is formed in a surrounding area (outer edge part) of the third bore part 54 at the end face of the first arm member 20 in the side of the first link 14. A fourth operating oil passage 76 connecting the first circular groove 73 and the third circular groove 77*a* in the side of the first arm member 20 is formed at the end face of the first arm member in the side of the first link 14.

A second operating oil passage 72 is connected to the first circular groove 73 and a flow of the operating oil is formed in the first circular groove 73, the fourth operating oil passage 76 and the third circular groove 77*a* in the side of the first arm member 20 through the second operating oil passage 72.

A circular groove in a circular-ring shape 75 (hereinafter referred to as "second circular groove") is formed in a surrounding area (outer edge part) of the second bore part 58 at an end face of the second arm member 21 in the side of the second link 18. A circular groove in a circular-ring shape 77*b* (hereinafter referred to as "third circular groove in the side of the second arm member") is formed in a surrounding area (outer edge part) of the third bore part 56 at the end face of the second arm member 21 in the side of the second link 18. The third circular groove 77*b* in the side of the second arm member 21 is connected to the third circular groove 77*a* in the side of the first arm member 20 through the engagement part between the third bore part 54 in the side of the first arm member 20 and the movable member 44. The third circular groove 77*a* in the side of the first arm member 20 and the third circular groove 77*b* in the side of the second arm member 21 constitute a third circular groove 77 provided in a surrounding area (outer edge part) of the movable member 44 constituting the third revolute pair and the engagement part of the corresponding bore parts 54, 56.

With the operating oil supply paths 71-77, it is possible to reserve a predetermined amount of the operating oil inside the sprocket 11 and the operating oil the inflow of which is limited is supplied through the clearance of the engagement part to appropriately lubricate the engagement part with the operating oil.

Further, in the first embodiment, as shown in FIG. 2B, a communicating passage 18*r* is provided in the contact face part 18*a* of the second link part 18 for communicating the damper chamber Dd with the outside (inside of the sprocket 11). As a result, when the contact face part 18*a* of the second link part 18 contacts each contact face part 75*a*, 76*a* of each stopper 75, 76, the damper chamber Dd is not completely closed from the sprocket 11. After the contacting, the damper chamber Dd is only partially closed from the sprocket 11 through the sliding clearance δ. Therefore, after the contacting, the operating oil pressure in the damper chamber Dd can be quickly made equal to that inside the sprocket 11.

In addition, in the first embodiment, it is preferable that stoppers 67, 68 are located in a relative rotational direction at the other of each second link part 18 to the one so as to sandwich the other. Therefore, it is possible to increase reliability in function for defining a changing angle of the relative phase in the relative rotational motion between the sprocket 11 and the output shaft 16. In this case, each stopper 67, 68 is provided in the first link part 14 and as shown in FIGS. 1 and 7, form predetermined clearances in the rotational direction to the other second link part 18. Thus, for example, even when one set of the stoppers 65, 66 are damaged, the other set of the stoppers 67, 68 can restrict the changing angle of the relative phase, maintaining a normal operating condition of the engine.

In the first embodiment as described above, the second link part 18 (cam plate) is provided to rotate integrally with the output shaft 16 out of the sprocket 11 and the output shaft 16 which rotate relatively with each other. The stoppers 65, 66 are provided in the sprocket 11 to restrict a rotational angle of the second link part 18 such that the second link part 18 can rotate in a predetermined range. Each stopper 65, 66 includes a contact face part 65*a*, 66*a* contacting the second link part 18, and each concave part 65*b*, 66*b* has a bottom located in the corresponding contact face part 65*a*, 66*a* such that the second link part 18 can be inserted into the concave part 65*b*, 66*b*. Further, the damper chamber Dd is defined between the each concave part 65*b*, 66*b* and the second link part 18.

As a result, when the second link part 18 is contacted to each stopper 65, 66 for defining the changing angle of the relative rotational phase between the sprocket 11 and the output shaft 16, the damper chamber Dd is formed between each concave part 65*b*, 66*b* of each stopper 65, 66 and the second link part 18. Accordingly, since the operating oil (e.g., reserved engine oil) is compressed and pressurized in the damper chamber Dd as the second link part 18 enters into each concave part 65*b*, 66*b*, the collision alleviation between the second link part 18 and each stopper 65, 66 can be made by the pressure damping effect.

Particularly, in the first embodiment, the convex part 18*d* which slides in each concave part 65*b*, 66*b* is disposed in the contact face part 18*a* of the second link part 18. Therefore, the damper chamber Dd can be formed in a simple structure composed of each concave part 65*b*, 66*b* of each stopper 65, 66 and the convex part 18*d* sliding in each concave part 65*b*, 66*b* disposed in the second link part 18. A size of the sliding clearance between each concave part 65*b*, 66*b* and the convex part 18*d* is changed by such simple collision alleviation mechanism, thereby making it possible to adjust the pressure damping effect for the collision alleviation.

In the first embodiment, the operating oil is partially reserved in the sprocket 11 to provide a predetermined amount of the operating oil. Further, in a state where the sprocket 11 and the output shaft 16 are rotating by rotational force of the crankshaft, the operating oil is constantly reserved to each stopper 65, 66.

As a result, the centrifugal force by the rotation of each rotating element 11, 16 is used to enable the operating oil in amount equal to the operating oil partially reserved in the sprocket 11 to be reserved in each stopper 65, 66.

Accordingly, even when the operating oil is not filled in the sprocket 11, only if the operating oil is reserved, the operating oil can be efficiently filled in the damper chamber Dd.

In addition, the operating oil thus reserved in the sprocket 11 can be supplied to the stopper any time. As a result, even in a case where the operating oil is partially reserved in the sprocket 11, since the operating oil is filled in the damper chamber Dd when the each stopper 65, 66 is contacted to the second link part 18, the pressure damping effect by the operating oil is securely generated in the damper chamber Dd.

In the first embodiment, it is preferable that each stopper 65, 66 is located at an outer peripheral part of the sprocket 11. Thereby, the operating oil reserved in the sprocket 11 can be efficiently supplied to each stopper 65, 66.

In the first embodiment, the operating oil supply paths 71-77 supplying the operating oil in the sprocket 11 are provided for reserving the operating oil in the sprocket 11. As a result, a predetermined amount of the operating oil can be securely reserved in the sprocket 11.

In the first embodiment, the operating oil supply paths 71-77 include each second operating oil passage 72, 74 connected to the engagement part between each shaft member 23, 25 constituting the revolute pair and each bore part 52, 58 in the first pair 24, the second pair 26 and the third pair 22 as the revolute pair. Thereby, the operating oil can be reserved in the sprocket 11 and the flow of the operating oil for supplying the operating oil to the engagement part between the each shaft member 23, 25 rotatable with each other and each bore part 52, 58 can be formed.

Further, the second sliding clearance between the bore parts 52, 58 corresponding to the engagement part and the shaft members 23, 25 may have a function of an orifice of limiting a flow amount in the sprocket 11 in response to a size of the clearance. As a result, it is possible to reserve a predetermined amount of the operating oil inside the sprocket 11 and the engagement part is lubricated with the operating oil by flowing the operating oil the inflow of which is limited through the clearance of the engagement part.

In addition, in the first embodiment, there are provided circular grooves 73, 75 for introducing the operating oil to a surrounding area (outer edge part) between the shaft members 23, 25 constituting the each revolute pair 24, 26 and the bore parts 52, 58. The second operating oil passage 72 is connected to the engagement part between the shaft member 23 and the first bore part 52 through the first circular groove 73. The third operating oil passage 74 is connected to the engagement part between the shaft member 25 and the second bore part 58 through the second circular groove 75.

Since the circular grooves 73, 75 leading the operating oil to the outer edge part of the engagement are provided, even if one of the above two members constituting the revolute pair rotates around the other by a motion of the revolute pair, the operating oil supply paths 71-77 can all the time form the flow of the operating oil to the engagement part.

Further, in the first embodiment, it is preferable that a communicating passage 18*r* is disposed in the contact face part 18*a* of the second link part 18 for communication between the damper chamber Dd and the outside (inside of the sprocket 11).

In general, after each stopper 65, 66 is contacted to the second link part 18, for example, when they move away from each other, the contact face parts 65*a*, 66*a*, 18*a* of each of the stoppers 65, 66 and the second link part 18 are temporarily adhered to each other.

Further, in the first embodiment, a communicating passage 18*r* is provided for communicating the damper chamber Dd with the inside of the sprocket 11. As a result, when the contact face part 18*a* of the second link part 18 contacts each contact face part 75*a*, 76*a* of each stopper 75, 76, the damper chamber Dd is not completely closed from the sprocket 11. After contact is made, the damper chamber Dd is only partially closed from the sprocket 11 through the sliding clearance δ. Therefore, after the contacting, the operating oil pressure in the damper chamber Dd can be quickly made equal to that inside the sprocket 11. Thus this prevents the contact face parts 65*a*, 66*a* of the stoppers 65, 66 and the contact face part 18*a* of the second link part 18 from being adhered to each other.

Accordingly, the collision alleviation to the stoppers 65, 66 for defining the changing angle of the relative rotational phase is achieved and also the changing angle of the relative rotational phase can be stably defined.

In addition, in general, in a case of controlling a predetermined motion of the revolute pair by the control means 30, 38, there is a case of temporarily ceasing applying a rotational torque for a motion of the revolute pair by, for example, the electric motor 30 of the control means 30, 38 to the arm members 20, 21. When it is ceased to apply the rotational torque to the arm members 20, 21, a relatively large impact torque may be applied when the second link part 18 collides with either one of the stoppers 65, 66 by the drive torque of the crank shaft and the operating torque for opening/closing the valve of the camshaft 2.

In contrast, since the first embodiment is provided with the damper chamber Dd for alleviating the collision to the stoppers 65, 66 of the second link part 18, reduction of the impact torque can be achieved.

Second Embodiment

The following paragraphs will describe other embodiments. In the following embodiments, components corresponding to those of the first embodiment are indicated with corresponding numerals and redundant explanation is not included.

Figure 9:
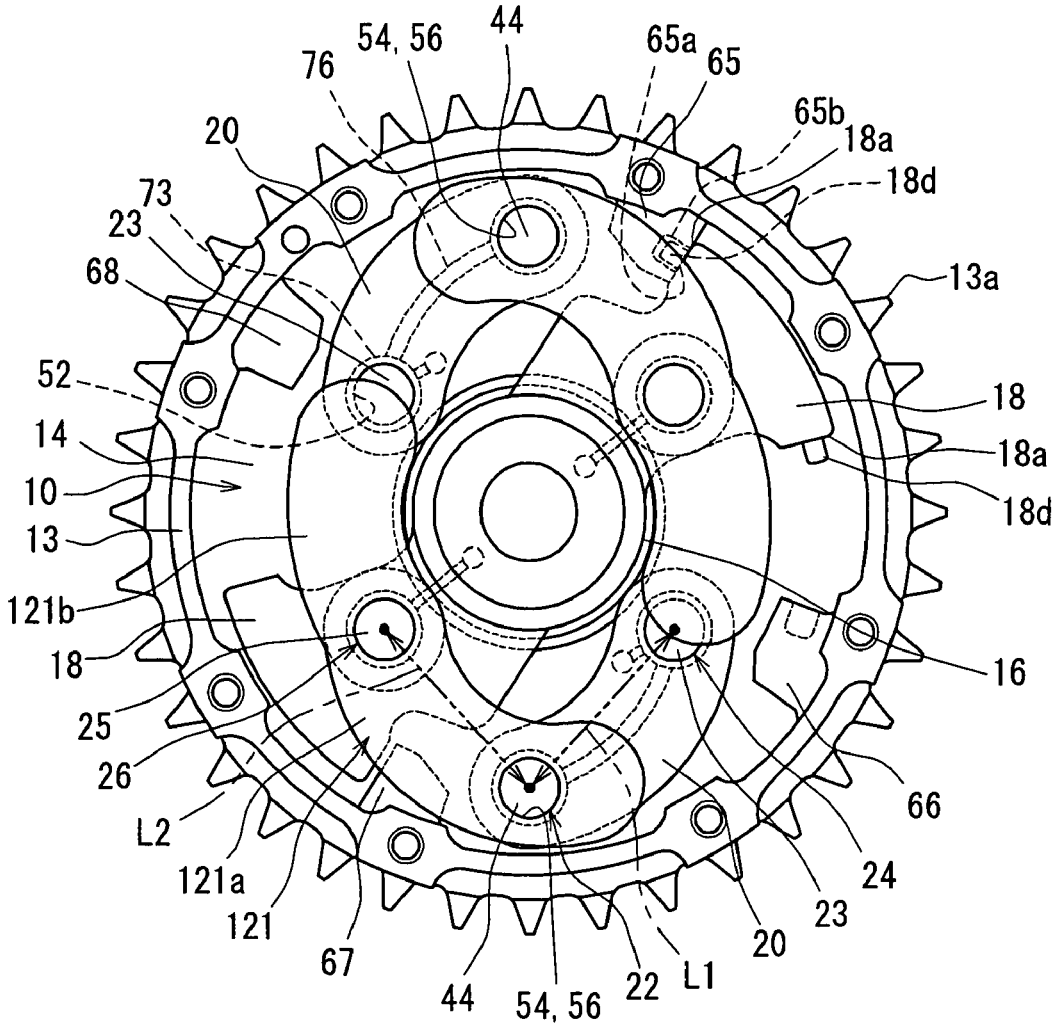
FIG. 9 is a cross sectional view of another embodiment of the valve timing controller.

In the first embodiment, on the end face of the first arm member 20 at the opposite side of the first link part, the opening of the engagement part between the shaft member 23 and the first bore part 52 is entirely exposed. In contrast, the second embodiment is, as shown in FIG. 9, structured such that only a portion of the opening of the engagement is exposed. FIG. 9 is a cross section showing an inside of a valve timing controller in the second embodiment.

As shown in FIG. 9, a second arm member 121 includes a second arm member body 121*a* corresponding to the second arm member 21 in the first embodiment and a second arm extending part 121*b* extending from the second arm member body 121*a* toward an end part of the first bore part 52 of the first arm member 20.

Such arrangement can also provide the same effect as in the first embodiment.

Further, a part of the opening of the engagement is closed with the tip part of the second arm member extending part 121*b* at any state of the most retard phase shown in FIG. 1 or the most advance phase (not shown) and only a part thereof is exposed. This can help reduce the operating oil flowing from the opening of the engagement part into the sprocket 11. Therefore, in a case of using a limited amount of the operating oil as in the case of controlling pressure reduction in the operating oil such as the engine oil to be low, it is possible to restrict an inflow amount of the operating oil into the sprocket 11 and also to maintain the limited operating oil inside the engagement part for lubricating.

Other Embodiment

As described above, the embodiments of the present invention are explained. However, the present invention is not to be limited to the above interpretation for the embodiments, but is able to be applied to various embodiments within the spirit of the intended purpose of the present invention.

In the embodiments mentioned above, the valve timing controller 1 which controls intake valve timing is explained. However, this present invention may be applied to a device for controlling exhaust valve timing, or a device for controlling both intake and exhaust valve timing. In addition, the above embodiments explain the valve timing controller 1 in which the sprocket 11 of the first rotating element is linked in motion to the crankshaft, and the output shaft 16 of the second rotating element is linked in motion to the camshaft 2, but the first rotating element may be linked in motion to the camshaft and the second rotating element may be linked in motion to the crankshaft.

In the embodiments as described above, it is explained that the stoppers 65, 65 are located in one second link part of the two second link parts 18 provided in the output shaft 16 for restricting a rotational angle of the one second link part 18. In another embodiment, the stoppers are located in the other second link part of the two second link parts 18 provided in the output shaft 16 for restricting a rotational angle of the other second link part 18.

In the embodiments as described above, it is explained that the means for reserving the operating oil inside the sprocket 11 is structured to dispose the operating oil supply paths 71-77 for supplying the operating oil inside the sprocket 11. In another embodiment, the means is an operating oil supply path having an orifice at an inlet port leading the operating oil to the sprocket 11. In addition, it is permitted to in advance reserve a predetermined amount of the operating oil inside the sprocket 11. In this case, the embodiment is structured not to use the oil pump 7 for the operating oil supply paths 71-77 or the operating oil supply path having the orifice supplying the operating oil into the sprocket 11.

In the embodiments as described above, the operating oil supply paths 71-77 include each second operating oil passage 72, 74 connected to the engagement part between each shaft member 23, 25 constituting the revolute pair and each bore part 52, 58 in the first pair 24, the second pair 26 and the third pair 22 as the revolute pair. The embodiment is not limited to this, but at least a set of the revolute pairs 24, 26, 22 may include an operating oil passage connected to the engagement part between the shaft member constituting the corresponding revolute pair and the bore part.

In addition, the embodiment as described above is so structured that the concave parts 65*b*, 66*b* are formed in the contact face parts 65*a*, 66*a* of the stoppers 65, 66, and the convex part 18*d* is formed on the contact face part 18*a* of the second link part 18, and not limited to this structure, but may be structured so as to form a convex part on the contact face parts 65*a*, 66*a* and form a concave part on the contact face part 18*a*. The embodiment may include any structure of providing a convex part on either one of the stoppers 65, 66 and the second link part 18 and providing a concave part on the other one.

Further, it is explained that the embodiment as described above is provided with the communication passage 18 in the contact face parts 65*a*, 66*b* of the stoppers 65, 66, and not limited to this, but may be structured to provide a communicating passage in each contact face part 18*a* of the second link part 18 corresponding to the contact face parts 65*a*, 66*b*. The embodiment may include any structure of providing a communicating passage in either one of the contact face parts 65*a*, 66*b* of the stoppers 65, 66, and each contact face part 18*a* of the second link part 18.

While only the selected example embodiments have been chosen to illustrate the present invention, it will be apparent to those skilled in the art from this disclosure that various changes and modifications can be made therein without departing from the scope of the invention as defined in the appended claims. Furthermore, the foregoing description of the example embodiments according to the present invention is provided for illustration only, and not for the purpose of limiting the invention as defined by the appended claims and their equivalents.

What is claimed is:

1. A valve timing controller disposed in a drive system which transmits torque of a drive shaft to a driven shaft for opening and closing of a valve to control opening and closing of the valve, the valve timing controller comprising:

a first rotating element which rotates in association with the drive shaft;

a second rotating element which rotates in association with the driven shaft;

a phase changing mechanism part including arm members for coupling to the first rotating element and the second rotating element by a revolute pair to change a relative rotational phase between the first rotating element and the second rotating element caused by motion of the revolute pair of the arm members;

a cam plate disposed at one of the first rotating element and the second rotating element so as to be rotated integrally therewith to be coupled to the arm members by the revolute pair; and a stopper disposed in the other of the first rotating element and the second rotating element to restrict a rotational angle of the cam plate in a predetermined range, wherein a changing angle of the relative rotational phase between the first rotating element and the second rotating element is defined by contacting the cam plate to the stopper, wherein:

a concave part having a bottom is disposed at one of the stopper and the cam plate and formed in a contact face part where the stopper and the cam plate contact such that the other is inserted into the concave part; and a damper chamber is defined between the concave part and the other of the stopper and the cam plate.

2. A valve timing controller according to claim 1, wherein:

the other is provided with a convex part which slides in the concave part.

3. A valve timing controller according to claim 1, wherein:

an operating fluid is reserved in the other rotating element and is supplied to the stopper.

4. A valve timing controller according to claim 2, wherein:

an operating fluid is reserved in a part of the other rotating element and is reserved to the stopper in a state when the first rotating element and the second rotating element are rotating by rotational force of the drive shaft.

5. A valve timing controller according to claim 3, further comprising:

an operating fluid supply path for supplying the operating fluid to the other rotating element.

6. A valve timing controller according to claim 5, wherein:

the operating fluid supply path is provided with an operating fluid passage at least one set constituting a revolute pair with each other among the arm members, the cam plate, the first rotating element, and the second rotating element so as to be connected to an engagement part between a shaft part and a bore part disposed in each of the two members as the one set constituting the revolute pair.

7. A valve timing controller according to claim 6, wherein:

at least one of the two members is provided with a circular groove for guiding the operating fluid at an outer edge part of one of the shaft part and the bore part in at least one of the two members and the operating oil passage is connected to the engagement part through the circular groove.

8. A valve timing controller according to claim 1, wherein:

the stopper is located in an outer peripheral part of the other rotating element.

9. A valve timing controller according to claim 1, wherein:

a communicating passage is provided in either one of contact face parts on which the stopper and the cam plate contact for communication between the damper chamber and an outside.

10. A valve timing controller according to claim 1, further comprising:

a control unit which controls a motion of the revolute pair of the arm members.

11. A valve timing controller according to claim 10, wherein:

the control unit includes an electric motor for generating rotational torque for the motion of the revolute pair.

* * * * *